US007954603B2

(12) United States Patent
Hikita et al.

(10) Patent No.: US 7,954,603 B2
(45) **Date of Patent: *Jun. 7, 2011**

(54) EVACUATION CONTROL APPARATUS FOR ELEVATORS INCLUDING A RESCUE FLOOR SETTING PORTION

(75) Inventors: Shiro Hikita, Tokyo (JP); Kiyoji Kawai, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 642 days.

This patent is subject to a terminal disclaimer.

(21) Appl. No.: 12/066,193

(22) PCT Filed: Jan. 12, 2006

(86) PCT No.: PCT/JP2006/300274

§ 371 (c)(1),
(2), (4) Date: Mar. 7, 2008

(87) PCT Pub. No.: WO2007/080636

PCT Pub. Date: Jul. 19, 2007

(65) Prior Publication Data

US 2009/0127030 A1 May 21, 2009

(51) Int. Cl.
*B66B 1/20* (2006.01)

(52) U.S. Cl. ..... 187/284; 187/287; 187/313

(58) Field of Classification Search ..... 187/247, 187/248, 313, 316, 317, 380–389, 391, 393
See application file for complete search history.

(56) References Cited

U.S. PATENT DOCUMENTS

| | | | | |
|---|---|---|---|---|
| 6,000,505 | A * | 12/1999 | Allen | 187/391 |
| 7,182,174 | B2 * | 2/2007 | Parrini et al. | 182/18 |
| 7,588,126 | B2 * | 9/2009 | Siikonen et al. | 187/384 |
| 7,594,564 | B2 * | 9/2009 | Siikonen et al. | 187/384 |
| 7,669,695 | B2 * | 3/2010 | Hikita et al. | 187/284 |
| 7,677,363 | B2 * | 3/2010 | Kawai | 187/387 |
| 2009/0038892 | A1 * | 2/2009 | Kawai et al. | 187/387 |
| 2010/0213011 | A1 * | 8/2010 | Hikita et al. | 187/247 |
| 2010/0224451 | A1 * | 9/2010 | Hikita et al. | 187/247 |
| 2010/0236868 | A1 * | 9/2010 | Hikita | 187/247 |

FOREIGN PATENT DOCUMENTS

| | | |
|---|---|---|
| JP | 50 90044 | 7/1975 |
| JP | 53-26028 | 7/1978 |
| JP | 64-013387 | 1/1989 |
| JP | 5 8954 | 1/1993 |
| JP | 5 147849 | 6/1993 |
| JP | 2005 104631 | 4/2005 |
| JP | 2005 187162 | 7/2005 |

* cited by examiner

*Primary Examiner* — Jonathan Salata
(74) *Attorney, Agent, or Firm* — Oblon, Spivak, McClelland, Maier & Neustadt, L.L.P.

(57) ABSTRACT

A building is provided with a plurality of service zones each including a plurality of floors, and elevators each assigned to the floors included in a corresponding one of the service zones as service floors. The service zones are provided such that the floors included in each of the service zones are at least partially different from the floors included in each of the other service zones. In an event of a fire in the building, an evacuation control apparatus for the elevators controls the elevators to convey those stranded in the building to a common evacuation floor. The evacuation control apparatus has a rescue floor setting portion for setting predetermined one of the service floors as rescue floors as to each of the service zones, and an evacuation operation command portion for controlling each of the elevators based on information from the rescue floor setting portion such that evacuation operation is performed to vertically reciprocate a corresponding one of cars between a corresponding one of the rescue floors and the evacuation floor.

8 Claims, 4 Drawing Sheets

EVACUATION CONTROL APPARATUS FOR ELEVATORS INCLUDING A RESCUE FLOOR SETTING PORTION

TECHNICAL FIELD

The present invention relates to an evacuation control apparatus for an elevator which serves to evacuate those stranded in a building when a fire occurs in the building.

BACKGROUND ART

Conventionally, there is proposed a system of operating elevators which is designed to perform control operation individually for each of a plurality of elevator groups to stop cars at nearest floors when a fire occurs in a building in which the plurality of elevator groups are installed. An order of priority for starting control operation is set for each of the elevator groups based on a fire occurrence floor. This control operation is started for the elevator groups in the order of the priorities set in advance. Thus, the duration of normal operation of those of the elevator groups which are not significantly influenced by the fire can be extended (see Patent Document 1).

Conventionally, there is also proposed a control apparatus for an elevator which guides a car to a floor other than a fire occurrence floor in the event of a fire (see Patent Document 2).

Patent Document 1: JP 05-8954 A

Patent Document 2: JP 05-147849 A

DISCLOSURE OF THE INVENTION

Problem to be Solved by the Invention

However, in the system of operating the elevators disclosed in Patent Document 1, the duration of normal operation of only one or some of the elevator groups can be extended. After the cars have been stopped through control operation, those in the building cannot be conveyed to an evacuation floor. As a result, the efficiency in conveying those stranded in the building in the event of a fire cannot be enhanced.

In the control apparatus for the elevator disclosed in Patent Document 2 as well, the car is stopped at a nearest floor through control operation in the event of the fire, so the efficiency in conveying those in a building in the event of the fire cannot be enhanced.

The present invention has been made to solve the above-mentioned problem, and it is therefore an object of the present invention to provide an evacuation control apparatus for an elevator which makes it possible to enhance the efficiency in conveying those stranded in a building in the event of a fire to an evacuation floor.

Means for Solving the Problem

An evacuation control apparatus for elevators according to the present invention controls operations of the elevators to convey those stranded in a building, which is provided with a plurality of service zones each including a plurality of floors such that the floors in each of the service zones are at least partially different from the floors in each of the other service zones while each of the service zones is individually provided with that one of the elevators which is assigned to the floors included in each of the service zones as service floors, to a common evacuation floor in an event of a fire in the building. The evacuation control apparatus includes: a rescue floor setting portion for setting predetermined one of the service floors as a rescue floor as to each of the service zones; and an evacuation operation command portion for controlling each of the elevators such that evacuation operation is performed to vertically reciprocate a corresponding one of cars between a corresponding one of the rescue floors and the evacuation floor.

BEST MODE FOR CARRYING OUT THE INVENTION

A preferred embodiment of the present invention will be described hereinafter with reference to the drawings.

Embodiment 1

Figure 1:
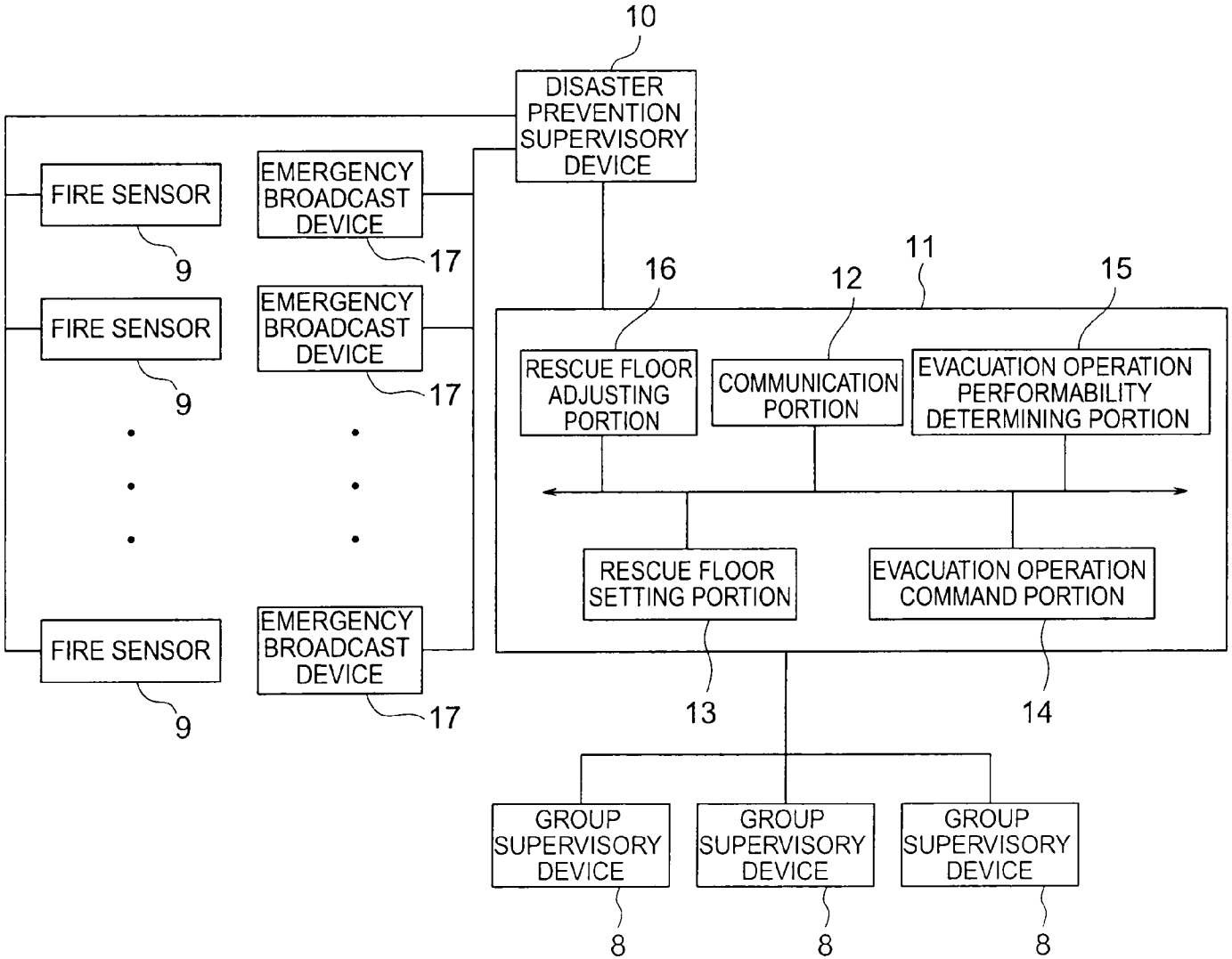
FIG. 1 is a block diagram showing an evacuation control apparatus for elevators according to Embodiment 1 of the present invention.
Figure 2:
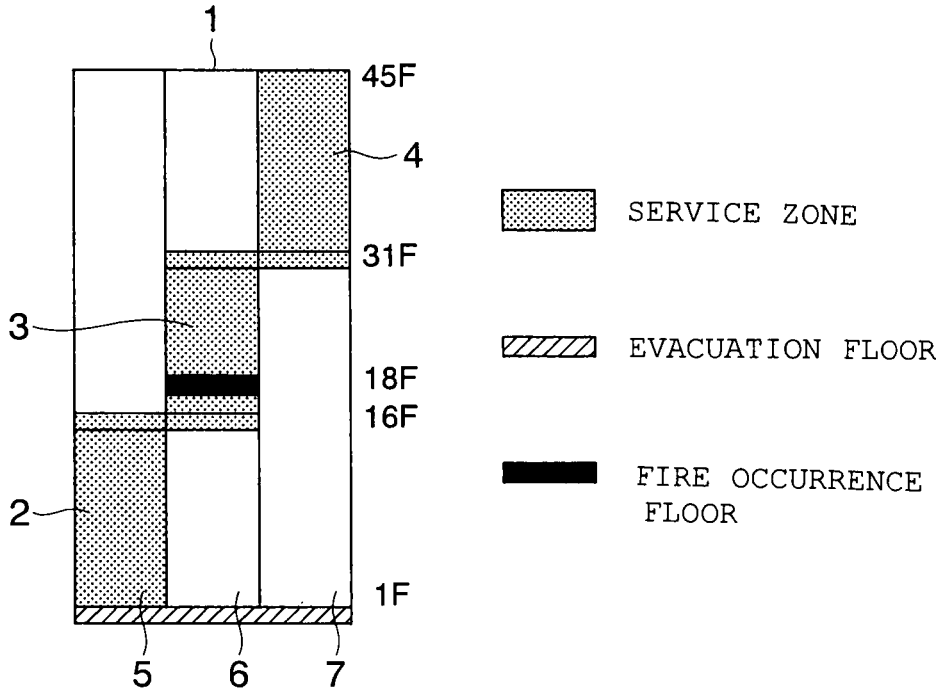
FIG. 2 is a schematic diagram showing a building provided with elevators that are controlled by the evacuation control apparatus for the elevators shown in FIG. 1.

FIG. 1 is a block diagram showing an evacuation control apparatus for elevators according to Embodiment 1 of the present invention. FIG. 2 is a schematic diagram showing a building provided with elevators that are controlled by the evacuation control apparatus for the elevators shown in FIG. 1. Referring to FIGS. 1 and 2, a building 1 having a plurality of floors (building of this example rises forty-five stories above the ground) is provided with a low-layer service zone 2 including the floors ranging from the second floor to the sixteenth floor, an intermediate-layer service zone 3 including the floors ranging from the sixteenth floor to the thirty-first floor, and a high-layer service zone 4 including the floors ranging from the thirty-first floor to the forty-fifth floor. That is, the building 1 is provided with the plurality (three in this example) of service zones 2 to 4 each including the plurality of floors, such that the floors in each of the service zones 2 to 4 are at least partially different from the floors in each of the other two service zones 2 to 4. The building 1 is also provided with a common evacuation floor that is not included in any one of the service zones 2 to 4. In this example, the evacuation floor is the lowest floor of the building 1, that is, the first floor.

In addition, the building 1 is provided with an elevator 5 on a low-layer bank which is assigned to the floors (ranging from the second floor to the sixteenth floor) included in the low-layer service zone 2 as service floors, an elevator 6 on an intermediate-layer bank which is assigned to the floors (ranging from the sixteenth floor to the thirty-first floor) included in the intermediate-layer service zone 3 as service floors, and an elevator 7 on a high-layer bank which is assigned to the floors (ranging from the thirty-first floor to the forty-fifth floor) included in the high-layer service zone 4 as service floors. That is, the building 1 is provided with the individual elevators 5 to 7 which are assigned to the floors included in the service zones 2 to 4, respectively.

Each of the elevators 5 to 7 on the respective banks has a plurality of elevator machines (not shown). Each of the elevator machines in the elevator 5 on the low-layer bank has a car that can be stopped at the service floors in the low-layer service zone 2 and the evacuation floor. Each of the elevator machines in the elevator 6 on the intermediate-layer bank has a car that can be stopped at the service floors in the intermediate-layer service zone 3 and the evacuation floor. Each of the elevator machines in the elevator 7 on the high-layer bank has a car that can be stopped at the service floors in the high-layer service zone 4 and the evacuation floor.

Each of the elevators 5 to 7 on the respective banks are provided with a group supervisory device 8 for controlling the operations of the elevator machines. That is, in each of the elevators 5 to 7, the cars are moved individually under the supervision of a corresponding one of the group supervisory devices 8.

Each of the floors of the building 1 is provided with a fire sensor 9 for sensing the occurrence of a fire. Information from the fire sensors 9 is transmitted to a disaster prevention supervisory device 10 for controlling disaster prevention components in the entire building 1 comprehensively. The disaster prevention supervisory device 10 detects whether or not a fire has occurred and identifies a fire occurrence floor, based on the information from the fire sensors 9. In the building shown in FIG. 2, the fire occurrence floor identified by the disaster prevention supervisory device 10 is the eighteenth floor.

Information from the disaster prevention supervisory device 10 is transmitted to an evacuation control apparatus 11 for controlling the group supervisory devices 8 comprehensively in the event of a fire. After the occurrence of the fire has been detected by the disaster prevention supervisory device 10, the evacuation control apparatus 11 performs evacuation operation for each of the elevators 5 to 7 to convey those stranded in the building 1 to the evacuation floor.

The evacuation control apparatus 11 has a communication portion 12, a rescue floor setting portion 13, an evacuation operation command portion 14, an evacuation operation performability determining portion 15, and a rescue floor adjusting portion 16.

The communication portion 12 allows each of the group supervisory devices 8 and the disaster prevention supervisory device 10 to exchange information with the evacuation control apparatus 11.

The rescue floor setting portion 13 sets a predetermined one of the service floors as a rescue floor as to each of the service zones 2 to 4. In this example, the rescue floor setting portion 13 sets, for each of the service zones 2 to 4, one rescue floor selected from the service floors included therein.

The rescue floors (predetermined service floors) and the evacuation floor are specified by vertically separating the building 1 into a plurality of separate zones, setting the lowest floor in the lowest one of the separate zones as the evacuation floor, and setting the lowest floors in the separate zones other than the lowest separate zone as the rescue floors (predetermined service floors). The number of the separate zones is larger than the number of the respective service zones 2 to 4 by one. That is, in the building 1 provided with elevators on N banks, the rescue floors (predetermined service floors) and the evacuation floor are specified by separating the building 1 into (N+1) separate zones, setting the lowest floor in the lowest one of the separate zones as the evacuation floor, and setting each of the lowest floors in the N separate zones other than the lowest separate zone as the predetermined service floor.

In the evacuation control apparatus 11, the predetermined service floors specified according to the foregoing method are stored in advance for each of the service zones 2 to 4. In setting the rescue floors, the rescue floor setting portion 13 reads the rescue floors stored in the evacuation control apparatus 11.

The number of the rescue floors set in each of the service zones 2 to 4 may be changed according to the number of the service floors included therein. For example, when the number of the service floors included in the service zone 2 is much larger than the number of the service floors included in each of the other service zones 3 and 4, the number of the rescue floors set in the service zone 2 may be made larger than the number of the rescue floors set in each of the other service zones 3 and 4.

Figure 3:
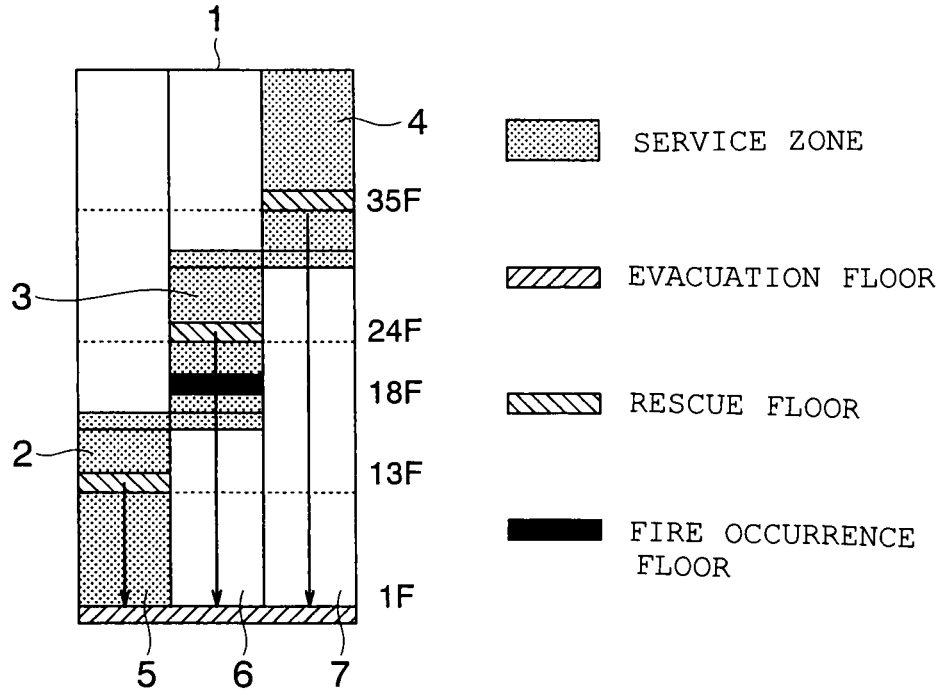
FIG. 3 is a schematic diagram showing the rescue floors set in the building of FIG. 2.

Reference will now be made to FIG. 3. FIG. 3 is a schematic diagram showing the rescue floors set in the building 1 of FIG. 2. As shown in FIG. 3, the building 1 provided with the elevators 5 to 7 on the three banks is separated into four separate zones. The lowest floor of the lowest separate zone is set as the evacuation floor, and each of the lowest floors in the two separate zones other than the lowest separate zone is set as the rescue floor (predetermined service floor). Accordingly, the evacuation floor and the rescue floors are different from one another.

Those in each of the separate zones of the building 1 move to a corresponding one of the rescue floors located below or to the evacuation floor by stairs. The rescue floors are set such that those in each of the separate zones of the building 1 cover the same distance in moving to a corresponding one of the rescue floors or to the evacuation floor by the stairs. The rescue floors may also be set such that the sum of a moving time taken by those in the building 1 in moving by the stairs and a conveyance time for conveying those in the building 1 from each of the rescue floors to the evacuation floor remains constant.

In this example, the separate zones are a first zone ranging from the first floor to the twelfth floor, a second zone ranging from the thirteenth floor to the twenty-third floor, a third zone ranging from the twenty-forth floor to the thirty-forth floor, and a forth zone ranging from the thirty-fifth floor to the forty-fifth floor. Accordingly, the predetermined service floors (rescue floors) are the thirteenth floor, the twenty-forth floor, and the thirty-fifth floor. The fire occurrence floor (eighteenth floor) is located in the second zone.

The evacuation operation command portion 14 outputs a command to perform evacuation operation to each of the group supervisory devices 8, based on information from the rescue floor setting portion 13. Upon receiving the command to perform evacuation operation from the evacuation operation command portion 14, each of the group supervisory devices 8 controls the elevator machine such that evacuation operation is performed to vertically reciprocate the car between a corresponding one of the rescue floors and the evacuation floor. During evacuation operation, each of the cars is moved directly between a corresponding one of the rescue floors and the evacuation floor. That is, during evacuation operation, each of the cars is stopped only at a corresponding one of the rescue floors and the evacuation floor, and moves past all the floors located between the corresponding one of the rescue floors and the evacuation floor.

The evacuation operation performability determining portion 15 determines whether or not evacuation operation can be performed as to each of the elevators 5 to 7, based on information from the disaster prevention supervisory device 10 and information from the rescue floor setting portion 13. That is, the evacuation operation performability determining portion 15 determines whether or not evacuation operation can be performed between each of the rescue floors and the evacuation floor, based on a positional relationship between the rescue floors and the fire occurrence floor. More specifically, the evacuation operation performability determining portion 15 determines that evacuation operation cannot be performed between each of the rescue floors and the evacuation floor when that rescue floor coincides with a floor in the building 1 where the fire is estimated to spread thereto (hereinafter referred to as "the fire spread estimated floor"), that is, the fire occurrence floor, the floor located directly above the fire occurrence floor, or the like, but determines that evacuation operation can be performed between that rescue floor and the evacuation floor when that rescue floor does not coincide therewith. The evacuation operation performability determining portion 15 determines whether or not evacuation operation can be performed, individually as to each of the rescue floors.

The rescue floor adjusting portion 16 adjusts the setting of the rescue floors by the rescue floor setting portion 13, based on information from the evacuation operation performability determining portion 15. That is, the rescue floor adjusting portion 16 cancels the setting of that one of the rescue floors where it is determined by the evacuation operation performability determining portion 15 that evacuation operation cannot be performed, and resets the service floor located directly below the fire occurrence floor as a rescue floor. Instead of the floor located directly below the fire occurrence floor, any floor located below the fire occurrence floor may be reset as a rescue floor.

Figure 4:
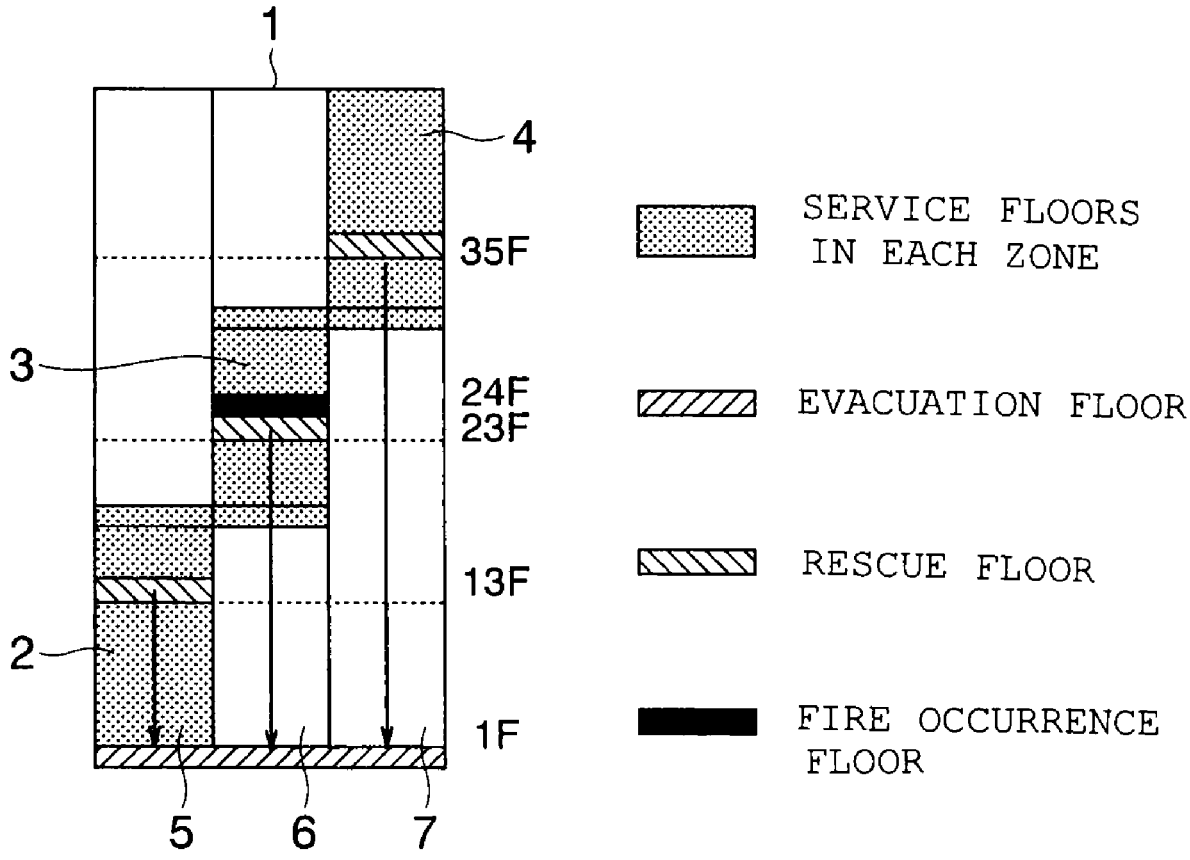
FIG. 4 is a schematic diagram showing the rescue floors in the building of FIG. 3 after the resetting.

Reference will now be made to FIG. 4. FIG. 4 is a schematic diagram showing the rescue floors in the building 1 of FIG. 3 after the resetting. As shown in FIG. 4, when the twenty-fourth floor, which is one of the rescue floors set by the rescue floor setting portion 13, is the fire occurrence floor, the rescue floor adjusting portion 16 cancels the setting of the twenty-fourth floor, which coincides with the fire occurrence floor, as the rescue floor. The rescue floor adjusting portion 16 resets the twenty-third floor, which is located directly below the fire occurrence floor, as a rescue floor. In addition, the setting of the thirteenth floor and the thirty-fifth floor, which are different from the fire spread estimated floors including the fire occurrence floor, as the rescue floors is left unchanged. That is, after the resetting by the rescue floor adjusting portion 16, the rescue floors are the thirteenth floor, the twenty-third floor, and the thirty-fifth floor.

When the rescue floor adjusting portion 16 adjusts the rescue floors, the evacuation operation command portion 14 outputs an evacuation operation command to each of the group supervisory devices 8 to perform evacuation operation between a corresponding one of the rescue floors after the resetting and the evacuation floor.

An emergency broadcast device 17 for guiding those in the building 1 to the rescue floors or the evacuation floor during evacuation operation is installed at each of the floors in the building 1. The emergency broadcast devices 17 announce those in the building 1 to move to the rescue floors, which are located directly below stair moving zones, or to the evacuation floor by the stairs.

The evacuation control apparatus 11 is constituted by a computer having a calculation processing portion (CPU), a storage portion (ROM, RAM, or the like), and signal input/output portions. The functions of the communication portion 12, the rescue floor setting portion 13, the evacuation operation command portion 14, the evacuation operation performability determining portion 15, and the rescue floor adjusting portion 16 are realized by the computer constituting the evacuation control apparatus 11.

That is, programs for realizing the functions of the communication portion 12, the rescue floor setting portion 13, the evacuation operation command portion 14, the evacuation operation performability determining portion 15, and the rescue floor adjusting portion 16 are stored in the storage portion of the computer. Information on the rescue floors is also stored in the storage portion. The calculation processing portion performs a calculation processing regarding the function of the evacuation control apparatus 11 based on the programs stored in the storage portion.

Figure 5:
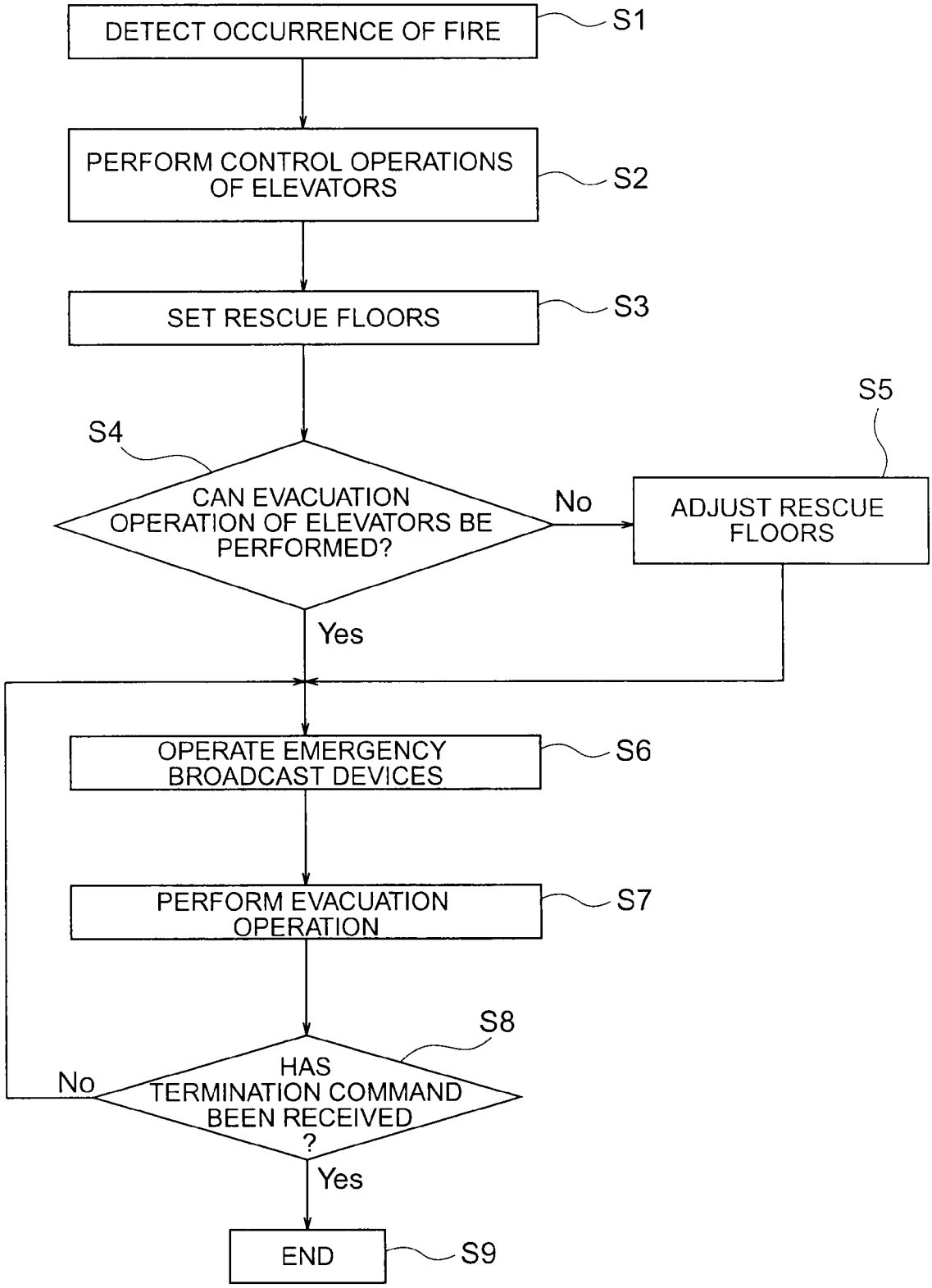
FIG. 5 is a flowchart for explaining the processing operation of the evacuation control apparatus shown in FIG. 1.

Next, an operation will be described. FIG. 5 is a flowchart for explaining the processing operation of the evacuation control apparatus 11 shown in FIG. 1. As shown in FIG. 5, when the occurrence of a fire is confirmed by the disaster prevention supervisory device 10 (S1), information on the fire occurrence floor or the like is transmitted from the disaster prevention supervisory device 10 to the evacuation control apparatus 11. After that, a command is output from the evacuation control apparatus 11 to each of the group supervisory devices 8, so control operation of a corresponding one of the elevators 5 to 7 is performed. In control operation, each of the moving cars is stopped at a nearest floor and caused to wait in a door-open state (S2).

After that, the rescue floor setting portion 13 sets the rescue floors (thirteenth floor, twenty-fourth floor, and thirty-fifth floor) as to the service zones 2 to 4, respectively. At this moment, the rescue floor setting portion 13 simultaneously sets the separate zones (S3).

After that, the evacuation operation performability determining portion 15 determines as to each of the rescue floors whether or not evacuation operation can be performed, based on information from the disaster prevention supervisory device 10 and information from the rescue floor setting portion 13 (S4).

When it is determined that evacuation operation cannot be performed, the rescue floor adjusting portion 16 cancels the setting of that one of the rescue floors which coincides with the fire spread estimated floor, and resets the service floor located directly below the fire occurrence floor as a rescue floor. That is, the rescue floor adjusting portion 16 adjusts the rescue floors (S5).

When it is determined that evacuation operation can be performed, the rescue floors are not adjusted, and the setting of the respective rescue floors by the rescue floor setting portion 13 is left unchanged.

After that, the emergency broadcast devices 17 start broadcasting in the building 1 under the supervision of the evacuation control apparatus 11 (S6). Thus, those in the first zone of the building 1, those in the second zone of the building 1, those in the third zone of the building 1, and those in the fourth zone of the building 1 are led to move to the first floor as the evacuation floor, the thirteenth floor as the rescue floor, the twenty-fourth floor as the rescue floor, and the thirty-fifth floor as the rescue floor, respectively, by the stairs.

Evacuation operation is also started as to each of the elevators 5 to 7 (S7). During evacuation operation, each of the cars vertically reciprocated between a corresponding one of the rescue floors and the evacuation floor. Thus, those at each of the rescue floors of the building 1 are conveyed therefrom to the evacuation floor.

After that, the evacuation control apparatus 11 determines whether or not the evacuation control apparatus 11 has received a termination command (S8). The evacuation control apparatus 11 receives the termination command, for example, when a termination button installed in each of the elevators 5 to 7 is manipulated, when an abnormality detecting sensor installed in each of the elevators 5 to 7 is actuated due to the spread of the fire, the inundation resulting from fire fighting, or the like, or when the absence of people getting on the cars at each of the rescue floors is detected by a boarding/disembarkation sensor or the like. That is, the evacuation control apparatus 11 receives the termination command when the continuation of evacuation operation becomes difficult or when a condition for completing evacuation operation is fulfilled.

When it is determined that the evacuation control apparatus 11 does not receive the termination command, broadcasting in the building 1 by the emergency broadcast devices 17 and evacuation operation of each of the elevators 5 to 7 are continued. When it is determined that the evacuation control apparatus 11 receives the termination command, evacuation operation of each of the elevators 5 to 7 is terminated (S9).

The evacuation control apparatus for the elevators configured as described above is provided with the rescue floor setting portion 13 for setting the predetermined rescue floor for each of the service zones 2 to 4 provided in the building 1 where a fire has occurred, and the evacuation operation command portion 14 for controlling each of the elevators 5 to 7 such that evacuation operation is performed to vertically reciprocate corresponding ones of the cars between a corresponding one of the rescue floors and the evacuation floor. Therefore, the number of the floors at which the cars are stopped can be reduced, so the efficiency in conveying those in the building 1 to the evacuation floor can be enhanced. Accordingly, a larger number of people in the building 1 can be conveyed to the evacuation floor in a short period of time.

In the building 1 provided with the elevators on the N banks, the predetermined service floors are specified by vertically separating the building 1 into the (N+1) separate zones, and setting the lowest floor in each of the N separate zones other than the lowest separate zone as a corresponding one of the predetermined service floors. Therefore, an appropriate number of the rescue floors corresponding to the number of the elevators can be set, and the distances among the rescue floors can also be set appropriately in accordance with the number of the floors of the building 1.

The evacuation control apparatus 11 is provided with the evacuation operation performability determining portion 15 for determining whether or not evacuation operation can be performed as to each of the rescue floors based on the positional relationship between the rescue floors and the fire occurrence floor, and with the rescue floor adjusting portion 16 for canceling the setting of that one of the rescue floors where it is determined by the evacuation operation performability determining portion 15 that evacuation operation cannot be performed and resetting one of the service floors located below the fire occurrence floor as a rescue floor. Therefore, evacuation operation can be performed while avoiding the influences of the spread of the fire and the like.

In the foregoing example, the single rescue floor is set for each of the service zones 2 to 4. However, those floors which are different from the floors already set as the rescue floors may be additionally set as rescue floors so that a plurality of rescue floors are set for each of the rescue floors. In this case, the rescue floor setting portion 13 additionally sets the rescue floors when the originally set rescue floors are estimated to be crowded with those in the building 1, for example, when the landings at the originally set rescue floors are too small. Each of the elevators 5 to 7 performs evacuation operation as to a corresponding one of the rescue floors with the tasks of evacuation operation assigned to the elevator machines. For example, when two rescue floors are set for one service zone, half of the elevator machines perform evacuation operation as to one of the rescue floors, and the other half of the elevator machines perform evacuation operation as to the other rescue floor. In this manner, the floors can be restrained from being crowded with those in the building 1, and the efficiency in conveying those in the building 1 to the evacuation floor can also be enhanced.

The invention claimed is:

1. An evacuation control apparatus for elevators, which controls operations of the elevators to convey those stranded in a building, which is provided with a plurality of service zones each including a plurality of floors such that the floors in each of the service zones are at least partially different from the floors in each of the other service zones while each of the service zones is individually provided with that one of the elevators which is assigned to the floors included in each of the service zones as service floors, to a common evacuation floor in an event of a fire in the building, the evacuation control apparatus comprising:

a rescue floor setting portion for setting predetermined one of the service floors as a rescue floor as to each of the service zones; and an evacuation operation command portion for controlling each of the elevators such that evacuation operation is performed to vertically reciprocate a corresponding one of cars between a corresponding one of the rescue floors and the evacuation floor.

2. An evacuation control apparatus for elevators according to claim 1, wherein:

the service zones are N in number and the elevators provided in the building are located on N banks corresponding to the service zones; and the predetermined ones of the service floors are specified by vertically separating the building into (N+1) separate zones and setting a lowest one of the floors in each of the N separate zones other than a lowest one of the separate zones as a corresponding one of the predetermined ones of the service floors.

3. An evacuation control apparatus for elevators according to claim 1, further comprising:

an evacuation operation performability determining portion for determining, based on a positional relationship between each of the rescue floors and a fire occurrence floor, whether or not the evacuation operation can be performed between each of the rescue floors and the evacuation floor; and a rescue floor adjusting portion for canceling setting of that one of the rescue floors where it is determined that the evacuation operation cannot be performed, and resetting one of the service floors located below the fire occurrence floor as one of the rescue floors.

4. An evacuation control apparatus for elevators according to claim 1, wherein the rescue floor setting portion additionally sets, as another rescue floor, one of the service floors included in each of the service zones which is different from the service floors already set as the rescue floors when the already set rescue floors are estimated to be crowded with those in the building.

5. An evacuation control apparatus for elevators, characterized by controlling operations of the respective elevators to convey those in a building, which is provided with a plurality of service zones each including a plurality of floors such that the floors in each of the service zones are at least partially different from the floors in each of the other service zones while each of the service zones is provided with that one of the elevators which is assigned to the floors included in each of the service zones as service floors, from a plurality of predetermined ones of the floors set as rescue floors to a common evacuation floor in an event of an emergency in the building.

6. An evacuation control apparatus for elevators according to claim 5, wherein the elevators provided in the building are located on N banks, and the building is vertically separated into (N+1) separate zones, and a lowest one of the floors in each of the N separate zones other than a lowest one of the separate zones is set as a corresponding one of the rescue floors.

7. An evacuation control method for elevators, which serves to control operations of the respective elevators in an event of a fire in a building, which is provided with a plurality of service zones each including a plurality of floors such that the floors in each of the service zones are at least partially different from the floors in each of the other service zones while each of the service zones is individually provided with that one of the elevators which is assigned to the floors included in each of the service zones as service floors, the evacuation control method comprising the steps of:

setting predetermined one of the service floors as rescue floors as to each of the service zones; and controlling each of the elevators such that evacuation operation is performed to vertically reciprocate a corresponding one of cars between a common evacuation floor and a corresponding one of the rescue floors.

8. An evacuation control method for elevators, which serves to control operations of the elevators in an event of an emergency in a building, which is provided with N service zones each including a plurality of floors such that the floors in each of the service zones are at least partially different from the floors in each of the other service zones and which is also provided with the elevators on N banks each of which is assigned to the floors included in a corresponding one of the service zones as service floors, the evacuation control method comprising the steps of:

vertically separating the building into (N+1) separate zones and setting a lowest one of the floors in each of the N separate zones other than a lowest one of the separate zones as a corresponding one of rescue floors; and controlling the operation of each of the elevators to convey those in the building from a corresponding one of the rescue floors to a common evacuation floor.

* * * * *